US007748450B2

(12) United States Patent
Mundell

(10) Patent No.: US 7,748,450 B2
(45) Date of Patent: Jul. 6, 2010

(54) GAS WELLHEAD EXTRACTION SYSTEM AND METHOD

(76) Inventor: Bret M. Mundell, 1635 E. E St., Casper, WY (US) 82601-2159

( * ) Notice: Subject to any disclaimer, the term of this patent is extended or adjusted under 35 U.S.C. 154(b) by 473 days.

(21) Appl. No.: 11/643,012

(22) Filed: Dec. 19, 2006

(65) Prior Publication Data

US 2009/0166034 A1 Jul. 2, 2009

Related U.S. Application Data

(60) Provisional application No. 60/753,192, filed on Dec. 19, 2005.

(51) Int. Cl.
*E21B 43/12* (2006.01)
*E21B 47/00* (2006.01)

(52) U.S. Cl. ..... 166/250.15; 166/53; 702/50

(58) Field of Classification Search ..... 166/250.15, 166/53; 702/50

See application file for complete search history.

(56) References Cited

U.S. PATENT DOCUMENTS 6,196,324 B1 * 3/2001 Giacomino et al. ..... 166/372
6,999,883 B1 * 2/2006 Brady et al. ..... 702/50

* cited by examiner

*Primary Examiner*—William P Neuder
(74) *Attorney, Agent, or Firm*—Holme Roberts & Owen LLC

(57) ABSTRACT

A method and apparatus for automating control, remotely monitoring, and controlling a gas extraction assembly, coupled to a gas pipeline section. The gas extraction assembly may be used to increase gas volume, and/or overall gas flow from productive low or high pressure wells, as well as "wake-up" or recover lowered production from depleting wells. Two features of the gas extraction assembly of the present invention is the capability of creating substantial differential pressure, along with the ability to create substantial vacuum pressure on the suction inlet.

28 Claims, 9 Drawing Sheets

GAS WELLHEAD EXTRACTION SYSTEM AND METHOD

RELATED U.S. APPLICATION DATA

This application claims priority from Provisional Application No. 60/753,192 filed on Dec. 19, 2005.

BACKGROUND OF THE INVENTION

1. The Field of the Invention

The present invention pertains to a gas wellhead extraction device for extracting additional methane or natural gas, from gas wells, i.e. either at the wellhead or applied "inline" prior to primary compression. More particularly, the present invention pertains to an improved gas wellhead extraction device and fully automated control panel that includes remote monitoring and operational wireless control.

2. The Relevant Technology

Significant gas is produced from coal bed methane and natural gas fields by means of natural free flow. Such flow is at a specific natural pressure and natural flow rate or psi. A gas wellhead extraction device may be utilized to extract additional gas directly from the wellhead, to increase line pressure or move additional gas volume through a gas pipeline versus natural free flow. The ambient air temperatures in such gas fields may exceed 100° F. during the summer, and regress to lower than minus 50° F. during the winter. In such fields, methane and/or natural gas flows twenty-four hours a day, 365 days a year. Consequently, the gas wellhead extraction device must be capable of near 100% runtime under all weather conditions. The gas wellhead extraction device must also be cost effective, relatively simple to maintain, and quick and easy to install, limiting gas flow disruption, or downtime during installation.

In addition, each potential customer may have several hundred gas wellhead extraction devices operating in one or more gas fields, making the gas wellhead extraction devices difficult to access in inclement weather conditions. Additionally, it becomes very difficult to visually inspect each gas wellhead extraction device on a daily basis, to assure proper operation, and to verify run time, without significant overhead and overall operational and maintenance costs. It is therefore desirable to adapt fully automated controls to a gas wellhead extraction device, thus allowing the operator to assure proper operation, verify run time, and maintain certain operating parameters from a remote location. It is also desirable to remotely program, update functions, extract data, and view or adjust operating parameters of the gas wellhead extraction device, from a remote location.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only one embodiment of the invention, and therefore are not to be considered in any way limiting of its scope. The invention will be described and explained with additional specificity and detail through the use of additional written description along with the accompanied drawings, in which.

DETAILED DESCRIPTION OF THE PREFERRED EMBODIMENTS

Reference will now be made in detail to the preferred embodiments of the present invention, examples of which are illustrated in the accompanying drawings. The various exemplary embodiments provide one example of a fully automated, variable frequency drive, remote monitored gas wellhead extraction device assembly that increases the production of natural gas or coal bed methane either from a direct wellhead application, or a down line installation on the pipeline prior to primary compression. The gas wellhead extraction device assembly of the present invention may be used to increase gas volume, and/or overall gas flow from productive low or high pressure wells, as well as "wake-up" or recover lowered production from depleting wells. Two features of the gas wellhead extraction device assembly of the present invention is the capability of creating substantial differential pressure, along with the ability to create substantial vacuum pressure on the suction inlet.

Figure 1:
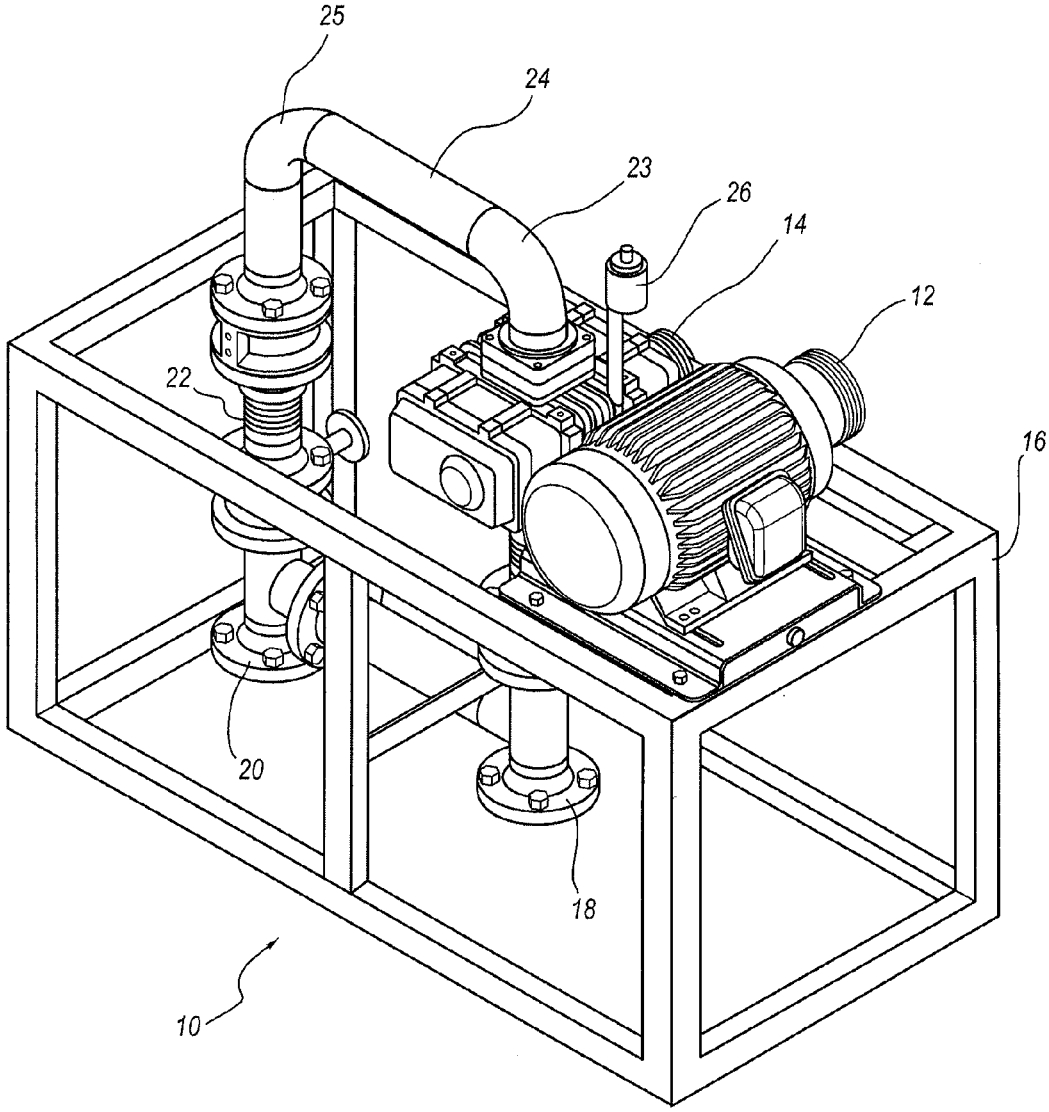
FIG. 1 illustrates one example of a gas wellhead extraction device assembly.

FIG. 1 illustrates one example of a gas wellhead extraction assembly 10 in accordance with the present invention. The gas wellhead extraction assembly 10 generally comprises a motor component 12 (either an AC electric motor, hydraulic motor, or a natural gas fired motor), generally coupled with either a gas tight positive displacement or rotary blower, liquid ring compressor, screw compressor or a gas tight positive displacement pump, collectively referred to as gas wellhead extraction device 14, along with a frame or general equipment mounting skid 16. In the illustrated embodiment, gas wellhead extraction device 14 is often described with reference to a gas tight positive displacement or rotary blower. It should be understood that a liquid ring compressor, screw compressor a gas tight positive displacement pump, a lobe or rotary blower, or any like device may be used without departing from the intended scope of the invention. Therefore, whenever reference is made to gas wellhead extraction device 14, it is understood that a positive displacement or rotary blower, a liquid ring compressor, screw compressor a gas tight positive displacement pump, or any like device may be used with equal effectiveness and generating similar results.

The motor component 12 generally comprises a multi-speed motor, such as a three-phase electric motor, a 4400 rpm hydraulic motor or a multi-range natural gas motor for powering gas wellhead extraction device 14. In the illustrated embodiment, motor component 12 is shown and described with reference to an AC electric motor. It should be understood that a multi-speed motor, such as a three-phase electric motor, a 4400 rpm hydraulic motor, or a multi-range natural gas motor or any like device may be used without departing from the intended scope of the invention. Therefore, whenever reference is made to motor component 12, it is understood that any motor may be used with equal effectiveness and generating similar results. In a preferred embodiment, the gas wellhead extraction assembly 14 is a low maintenance design. In one embodiment, the gas wellhead extraction assembly 10 has the capability to safely operate with discharge temperatures as high as 320° F. In another embodiment, the motor component 12 and the extraction device 14 could be configured to mount onto a surface frame, or deck of a general equipment mounting skid 16. Both components could be driven by a belt and sheave configuration, or directly driven with a suitable direct drive coupler.

Gas wellhead extraction assembly 10 could be configured to be coupled either directly to a gas wellhead or coupled inline to a pipeline prior to primary compression. In one embodiment, the extraction assembly 10 has an inlet flange, or connection fitting, 18 that is adapted to be coupled to either the inlet side of a gas wellhead or adapted to be coupled further down line prior to primary compression. The gas wellhead extraction assembly 10 also has an outlet flange, or connection fitting, 20 that is adapted to be coupled to either the outlet side of a gas wellhead or adapted to be coupled further down line prior to primary compression. Pre-fabricated inlet and outlet connection fittings further limit the need for additional costly onsite pipefitting and welding, while more cost effectively and expeditiously connecting the gas wellhead extraction assembly 10 to the wellhead or downstream pipeline prior to primary compression. In a preferred gas wellhead extraction device embodiment, all piping configurations and connections are welded rather than threaded, limiting the possibility of oxygen induction into the system. Welding of all piping configurations and connections drastically reduces the possibility of oxygen being introduced into the system, and thereafter the gas stream, thus limiting the possibility of contaminating the outgoing gas stream that is boosted through gas wellhead extraction device 14.

Figure 2:
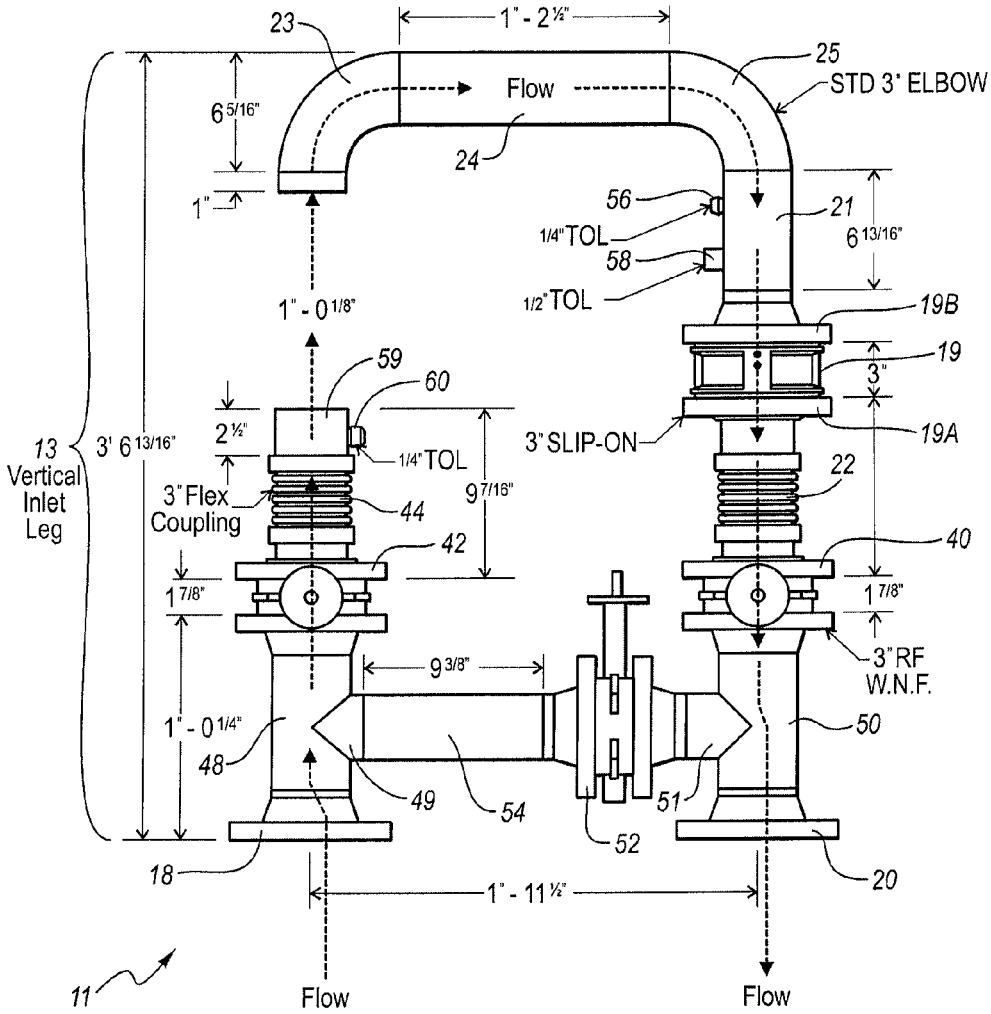
FIG. 2 illustrates one example of a piping and valve configuration assembly of a gas wellhead extraction device.

FIG. 2 illustrates one example (front view) of a piping and valve configuration 11, of a gas wellhead extraction assembly 10. Piping and valve configuration 11 has a T-inlet pipe section 48 coupled to inlet flange 18. The 90° section 49 of T-inlet pipe section 48 comprises a portion of the automatic free flow bypass assembly of the gas wellhead extraction assembly 10. Piping and valve configuration 11 has a T-outlet pipe section 50 coupled to outlet flange 20. The 90° section 51 of T-outlet pipe section 50 also comprises a section of the automatic free flow bypass assembly of the gas wellhead extraction assembly 10. The ninety-degree (90°) section 49 is coupled to the ninety-degree (90°) section 51 using a straight pipe section 54 containing an automated valve or check valve 52.

Automated valve or check valve 52 operates as a free flow bypass valve, opening automatically if either the gas wellhead extraction device temporarily 14 shuts down, or if the conditions or operating parameters of the gas wellhead extraction assembly 10 are not optimal. Such conditions or operating parameters may include overheating the motor component 12; infringing maximum discharge pressure limits; infringing the maximum internal temperature limits of the casing of the gas wellhead extraction device 14; infringing maximum differential pressure limits; infringing maximum suction pressure limits; infringing selected concentration limits of selected components of the gas present in the pipeline, such as maximum oxygen limits in parts per million; infringing maximum discharge gas temperature limits, or; infringing maximum limits on the amount of water produced. All of the conditions which engage the automated valve or check valve 52 to open allow the natural gas of the well to flow under the in situ, or natural, pressure of the gas in the reservoir and to bypass the gas wellhead extraction device 14 and to "free flow" through the pipeline without causing gas flow disruption, which in turn eliminates down line compression shut down due to lack of gas, or gas restriction.

The automated valve or check valve 52 may be configured to close when conditions return to normal or become optimal, thus gas wellhead extraction assembly 10 returns to normal operation, i.e., the gas flows through the gas wellhead extraction device assembly. Automated valve or check valve 52 may also be opened to service elements of gas wellhead extraction assembly 10, allowing for repairs, general maintenance, or replacement of gas wellhead extraction device 14 that would otherwise require gas flow through the wellhead or pipeline to be stopped, all without restricting natural gas flow to down line equipment or primary compression. In other words, gas production could continue while general maintenance occurs. Automated valve or check valve 52 may be manually operated and/or fully automatic.

Continuing with FIG. 2, T-inlet pipe section 48 is coupled to a first manual or automated valve 42 on vertical inlet leg 13, and T-outlet pipe section 50 is coupled to a second manual or automated valve 40 on vertical outlet leg 15. The first and second manual or automated valves 42 and 40 on vertical inlet leg 13 and vertical outlet leg 15, may be closed to isolate the gas wellhead extraction device 14 during repair, maintenance or replacement. First manual or automated valve 42 is coupled to a first flex coupling 44, and second manual or automated valve 40 is coupled to a second flex coupling 22. The first flex coupling 22 and the second flex coupling 44 are configured to assist in proper sealing of the inlet flange 18 and outlet flange 20 during the installation process. If, for example, the gas wellhead extraction assembly 10 is installed on a non-level surface, or the pre-fabricated inlet and outlet connection fittings are not level, the first flex coupling 22 and the second flex coupling 44 will bend or adjust to compensate "horizontal level," allowing inlet flange 18 and outlet flange 20 to properly seal against the wellhead or pipeline. Proper sealing of inlet flange 18 and outlet flange 20 may aide in eliminating oxygen induction on the inlet side, and gas leaks on the outlet side of gas wellhead extraction assembly 10. First flex coupling 22 and second flex coupling 44 are also incorporated to alleviate unwanted connection pressure from both vertical inlet leg 13 and vertical outlet leg 15.

The first flex coupling 44 is connected to a short vertical inlet pipe section 59. The short vertical inlet pipe section 59 may have connection fittings for one or more sensors that are electrical communication with the control panel system, as discussed in further detail below. For example, the short vertical inlet pipe section 59 has a first sensor connection fitting 60 that fluidly couples a first sensor (not shown), a transducer in this example, into the gas flow within vertical inlet leg 13. The first sensor, or transducer, connected at the first sensor connection fitting 60, may operate to measure a suction pressure produced by gas wellhead extraction device 14 and relay suction pressure back to the automated control panel 100 (not illustrated in FIG. 2) for variable processing. Optionally, the first sensor or other additional sensors may be placed elsewhere on the gas wellhead extraction assembly as desired.

Referring to the vertical outlet leg 15, vertical pipe section 21 is coupled to elbow 23. Elbow 23 is coupled to horizontal pipe section 25, which is in turn coupled to elbow 23. Elbow 23 and short vertical inlet pipe section 59 are coupled to gas wellhead extraction device 14 (not illustrated in FIG. 2).

The piping configuration detailed above and included in FIG. 2 represents only one piping configuration example that creates a passageway for the flow of gas from inlet flange 18 to wellhead extraction device 14 and out to outlet flange 20. Thereafter, gas passes back through the wellhead discharge line, or back through the discharge side of the gas pipeline. The incorporation and function of the by-pass assembly made up of 18, 48, 49, 54, 52, 51, 50, and 20, also represents only one configuration example where thereafter the gas passes back through the wellhead discharge line, or back through the discharge side of the gas pipeline.

Referring again to vertical outlet leg 15 in FIG. 2, the second flex coupling 22 is connected to flange 19(A). Flange 19(A) is coupled to check valve 19. Check valve 19 is coupled to flange 19(B), which is coupled to vertical pipe section 21. Vertical pipe section 21 may include sensor fittings or connections. For example, vertical pipe section 21 may have a second sensor connection fitting 56, and a third sensor connection fitting 58, to fluidly couple a second sensor (not shown), such as a pressure transducer at the second sensor connection fitting 56, and a third sensor (not shown), such as a temperature transducer at the third sensor connection fitting 58, to the gas flow within vertical pipe section 21. Continuing with the example of a pressure transducer as the second sensor connected at the second sensor connection fitting 56, the second sensor may measure the discharge gas pressure within vertical outlet leg 15 and relay the information back to the automated control panel 100 (not illustrated in FIG. 2) for variable processing. The third sensor, a temperature transducer, connected at third sensor connection fitting 58 may measure the discharge gas temperature within vertical outlet leg 15 and also relay the information back to automated control panel 100 (not illustrated in FIG. 2) for variable processing.

The H-design bypass assembly incorporated in the piping configuration of the vertical inlet leg 13 and vertical outlet leg 15 to gas wellhead extraction device 14 allows gas to free flow or "bypass" the gas wellhead extraction device 14 under any condition that inhibits the gas wellhead extraction assembly 10 from operating, or during "shutdown." Equipment shutdown may occur when operating parameters or conditions are in excess of set point limits, or during preventative maintenance on gas wellhead extraction device 14. Vertical inlet leg 13 coupled to gas wellhead extraction device 14 prevents the accumulation of condensation and moisture within the gas wellhead extraction device 14, due to the fact that gas wellhead extraction device 14 is configured with gas wellhead extraction assembly 10 to allow gas to be drawn from the bottom of inlet flange 18 with the suction created by the gas wellhead extraction device, rotated clockwise through the gas wellhead extraction device 14, and discharged out the top discharge flange (not shown in FIG. 2) of the gas wellhead extraction device 14. This configuration decreases the possibility of condensation fluid building up by allowing excess fluid or condensation to naturally fall back through gas wellhead extraction device 14, thereby minimizing the potential for water retention in the casing (not shown in FIG. 2) of the gas wellhead extraction device 14 that, when not properly drained before restart, may result in catastrophic failure.

Catastrophic failure due to water retention in the casing of gas wellhead extraction device 14 may occur when lobes, rotors, rings, or general internal operating components are knocked out of timing or are dislodged due to excess volume displacement and/or water pressure in the primary or secondary casing of the gas wellhead extraction device 14. The overall design and engineering concepts behind gas wellhead extraction assembly 10 allow for clean, quick, and cost effective installation and maintenance that limits the time that the flow of gas must be stopped to install or to maintain the gas wellhead extraction assembly 10. Such benefits accrue, in part, because the gas wellhead extraction assembly 10 employs only a single inlet connection like inlet flange 18 and a single outlet connection like outlet flange 20 that allows gas to free flow through the proprietary (H) bypass assembly during the completion of initial installation or upon shutdown of gas extraction wellhead assembly 10.

In a standard application of gas wellhead extraction assembly 10, gas flows from the pipeline, which may include a wellhead, through inlet flange 18, through vertical inlet leg 13 and gas wellhead extraction device 14, through horizontal leg 24, vertical outlet leg 15, and back to the pipeline via outlet flange 20. In a by-pass condition, gas flows under the natural pressure (i.e., the gas wellhead extraction device 14 is not supplying any suction to the gas flow) of gas present in the wellhead or pipeline into the inlet flange 18 and through the bypass assembly comprising the T-inlet pipe section 48, the straight pipe section 54, check valve 52, T-outlet pipe section 50, and finally exiting through outlet flange 20 into the outlet side of the pipeline or wellhead, thereby bypassing the gas wellhead extraction assembly 14.

Referring back to FIG. 1, a visual pre-seal failure indicator, or oil reservoir, 26 may be included with gas wellhead extraction device 14. Typically, a visual pre-seal failure indicator, or oil reservoir, 26 is a see-through sight glass or substantially clear container that suspends or holds a fluid indicator. Visual pre-seal failure indicator 26 may ensure proper mechanical operations by decreasing the risk of partial or complete failure of seals within gas wellhead extraction device 14 from occurring. Such failures may otherwise allow oxygen into the system and contaminate the gas or potentially create an explosion hazard if the oxygen is present in sufficiently high concentrations.

Gas wellhead extraction assembly 10 is one example of a preassembled configuration typically completed in its entirety and transported to the gas wellhead or pipeline intersection installation location. In operation, inlet flange, or fitting, 18 is coupled to the inlet side of the wellhead or the intersection in the gas pipeline inlet section, and outlet flange, or fitting, 20 is coupled to the outlet side of the wellhead or the intersection in the gas pipeline outlet section. The necessary power connections whether hydraulic, natural gas, or electrical are made to complete the installation of the motor component 12. Installation may also include an inlet water or particulate separator if needed or desired to protect the gas wellhead extraction device 14. Motor component 12 is coupled to and provides power to the gas wellhead extraction device 14, allowing the gas wellhead extraction device 14 to create a suction that may allow additional gas to flow or be extracted from the wellhead or intersected through the gas pipeline.

Typically, gas wellhead extraction assembly 10 is self-sufficient in that it runs off either methane or natural gas, hydraulics, or electricity. In most cases the motor component 12 has power at the wellhead through a connection to a nearby electrical distribution grid or system if such a system. If a connection to such an electrical grid is not possible, power may be supplied to the gas wellhead extraction assembly through a portable electrical generator set, a natural gas engine that powers a hydraulic system, or a natural gas driven engine, including those that run off a portion of the gas present in the pipeline or wellhead. In an additional or alternate embodiment, the unit may be solar powered, wind power generated, or powered using a natural gas generator that may feed multiple gas wellhead extraction assemblies 10 simultaneously.

Gas wellhead extraction device 14 of gas wellhead extraction assembly 10 is designed to be manually or automatically calibrated to operate at optimum speed and efficiency, delivering the maximum production enhancement of gas, i.e., maximum gas production rate, while remaining within maximum preset or pre-determined operating parameters. Such parameters may include, among others, suction pressure, discharge pressure, differential pressure, discharge gas temperature, the temperature of the casing of the gas wellhead extraction device, the concentration of selected components of the gas, including the concentration of oxygen in the gas, the flow rate of the gas, and wellhead water column levels. In addition to maximizing production enhancement, the gas wellhead extraction assembly 10 may be operated such that the operating parameters are optimized to maximize: return on investment; the productive life of a well; the mean time between failure of the gas wellhead extraction assembly 10, and; producing a minimum amount of water.

Figure 3:
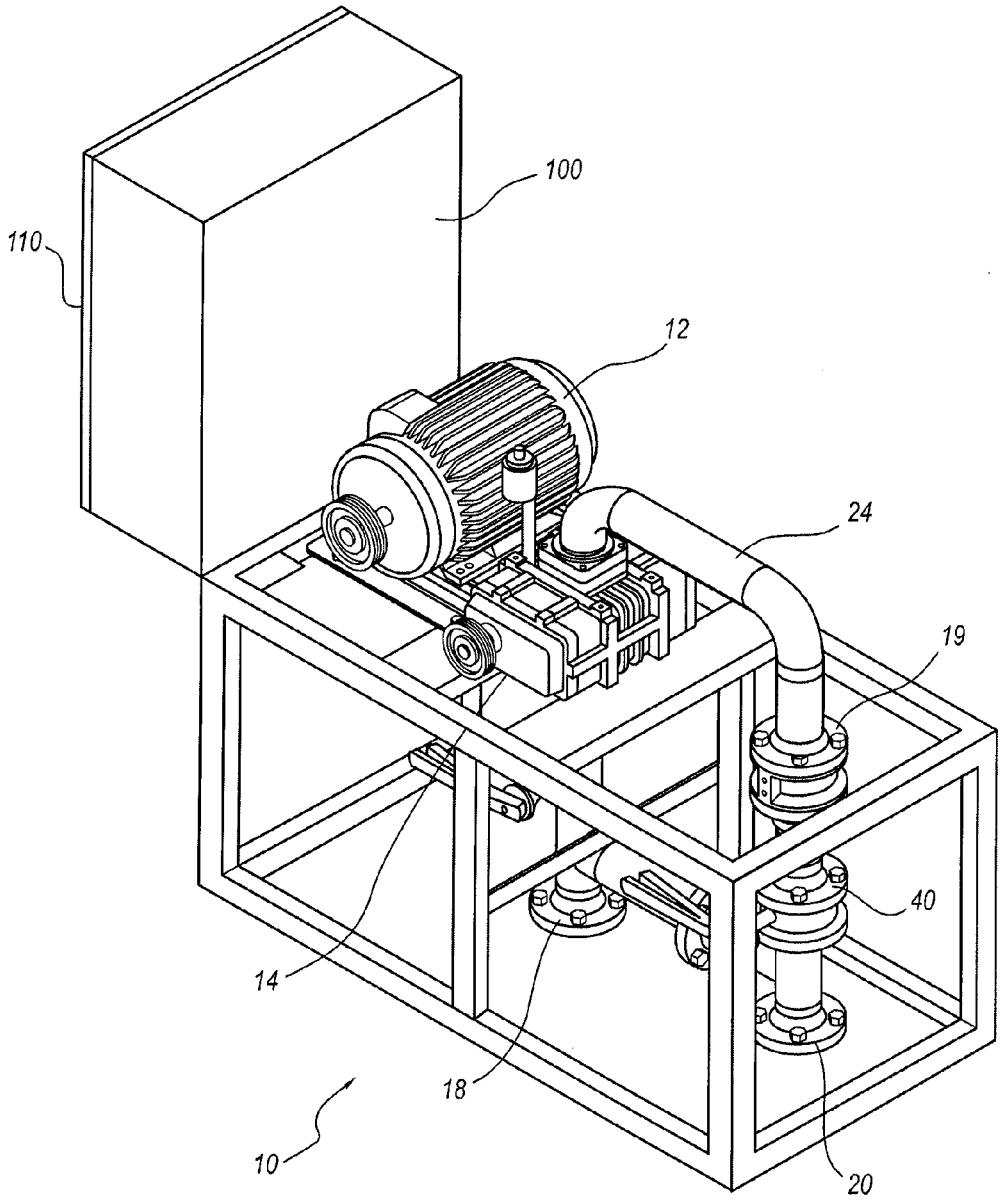
FIG. 3 illustrates one example of a gas wellhead extraction device having a fully automated control panel mounted to house the controls for the gas wellhead extraction device.

FIG. 3 illustrates one example of a gas wellhead extraction assembly 10 having a fully automated and integrated control panel 100. Fully automated control panel 100 may have a control panel door 110 that facilitates access to the control elements illustrated and explained in FIGS. 5 through 7.

The automated control panel 100 may configured to minimize or reduce the risk of an explosion because the air external to the automated control panel 100 may contain natural gas, methane, hydrogen sulfide, or other inflammable gases that could ignite in the presence of oxygen and any ignition source present in the automated control panel 100. For example, the automated control panel may be rated explosion proof, "intrinsically safe," or pressurized, or any combination thereof. Explosion proofing the automated control panel may encompass provided a rigid structure and appropriate seals designed to contain any fire or explosion within the automated control panel 100. Another option is to make the automated control panel 100 "intrinsically safe," which indicates that the electrical power within the automated control panel 100 is insufficient to ignite any inflammable gases within the system. An electrical connection between the automated control panel 100 and any sensors present, as well as the sensors themselves, may be intrinsically safe, as described below. Optionally, the automated control panel 100 may be pressurized, which indicates that a source of compressed air (not compressed ambient air that may contain inflammable gases) flows into the automated control panel 100 and keeps the control panel at a slightly higher pressure than the ambient air pressure, thereby preventing any ambient air from entering the automated control panel 100. If a pressurized system is used, the automated control panel 100 may include a fail safe that powers down the automated control panel 100 should the automated control panel 100 become unpressurized relative to the ambient air pressure.

In addition to minimizing the risk of fire or explosion, the automated control panel 100 may be hardened to electrical surges caused by lightning strikes. Such hardening may include surge suppressors, diode (zener) barriers, grounding cables and the like.

Figure 4:
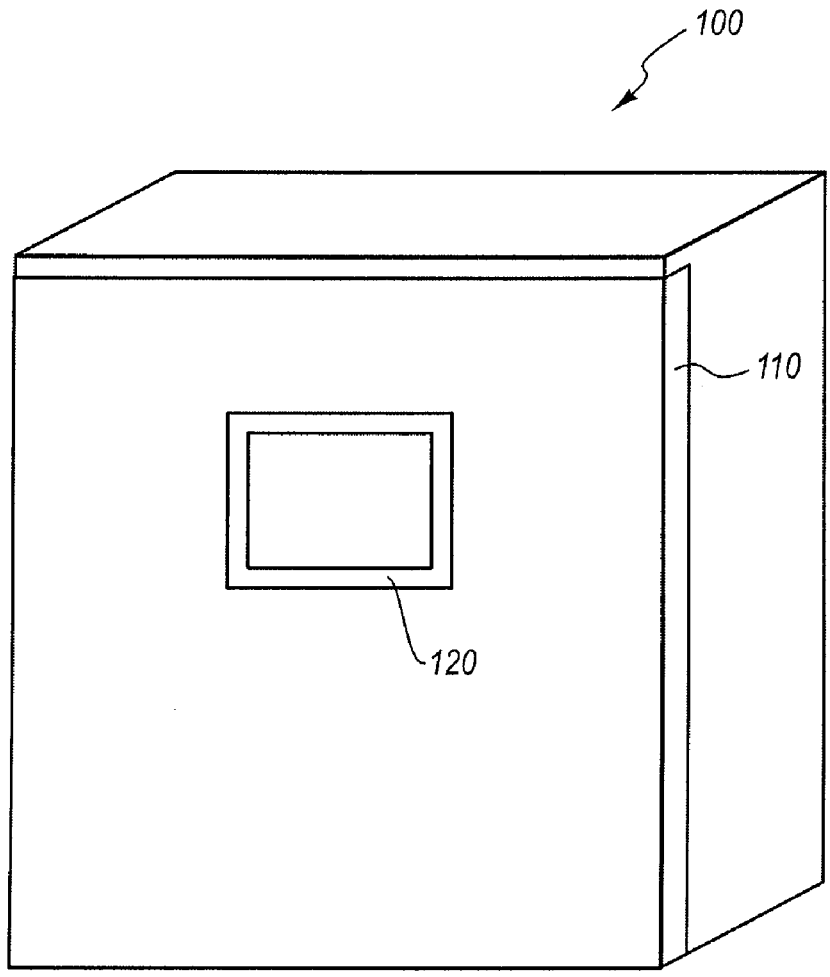
FIG. 4 illustrates one example of a front view of the fully automated control panel.

Continuing, FIG. 4 shows one example of a fully automated control panel 100 which is integrated into system and which may include a touch-screen, a programmable memory button screen, a text screen, or wireless display screen 120. Wireless display screen 120 may allow an operator to view operating conditions, adjust operating parameters, set security passwords, designate security levels, engage auto re-start functions, extract historical operating data or enable remote communications at the physical gas wellhead extraction device itself. Wireless 120 may also include various levels of encrypted password protection to maintain security levels and limit access to qualified and/or technical engineering personnel only.

The fully automated control panel 100 also houses, in a locked interior/exterior, a series of elements that provide both onsite and remote wireless monitoring and control of gas wellhead extraction assembly 10, including both WiFi and Voice over IP (VoIP) broadcast capability. As shown in two embodiments illustrated in FIGS. 5 and 6, various control elements may be provided that allow for remote or wireless monitoring, control by way of telemetry, low frequency RF, radio, satellite, wireless local area networks, cellular networks, or other wireless or like RF service that may contain the capacity of relaying wireless data functions to the automated control of panel 100. Additionally, the wireless communication system may send the control a time stamp or other time designation for the automated control panel 100 to record and correlate with the data measured by the sensors and stored in a memory storage system, as discussed in further detail below. Such wireless remote operation and data transfer may allow for more cost effective and efficient operation of the gas wellhead extraction assembly 10. Wireless and remote operation along with WiFi broadcast and VoIP infrastructure provides an unquantifiable operating advantage to gas wellhead extraction assembly 10. Additionally, wireless and remote operation of gas wellhead extraction assembly 10 also creates substantial run time advantages for the potential customer or equipment leasing company. Other advantages include use in remote locations where access to the gas wellhead extraction assembly may be limited due to distances between equipment, road access, or adverse weather conditions.

The fully automated control panel 100 may be configured to monitor and control a plurality of operating parameters, including: i) a suction pressure using a sensor such as a pressure transducer or other device on vertical inlet leg 13; ii) a discharge pressure using another sensor such as a pressure transducer or other device on vertical outlet leg 15; iii) a differential pressure determined by calculating the difference between the suction pressure and the discharge pressure; iv) a gas temperature using a sensor such as a temperature transducer, probe, or other device on vertical outlet leg 15; v) an identification of a selected component in the gas in the pipeline, including an oxygen detection and concentration sensor using an $O_2$ meter or other device that measures the concentration of oxygen in the vertical outlet leg 15; vi) a gas flow measurement, including a flow rate, using either an external or integrated flow computer, flow meters, Venturi meters, or similar devices, that calculates pre- and post-gas flow on vertical outlet leg 15, which is measured, calculated and analyzed for optimum operational function by the fully automated control panel 100; vii) a downhole water measurement using either a submersible or surface pump, along with an external or integrated variable frequency drive (VFD), together with either a down hole sensor, transducer, or like device that measures and regulates downhole water levels to determine optimum settings to enhance gas flow and minimize water production; viii) a temperature of the casing of the gas wellhead extraction device 14 using a temperature sensors, transducer, probe, or other like device coupled either internally or externally to the casing of the gas wellhead extraction device 14, and; ix) a diurnal condition at a location of the gas wellhead extraction assembly 10, using a sensor configured to determine the daytime/night-time condition at the location, such as a photo-eye.

In one embodiment, the upper and lower operating limits of the plurality of parameters, including the suction pressure, discharge pressure, differential pressure, discharge gas temperature, gas oxygen concentration in ppm, gas flow rate, casing temperature of the gas wellhead extraction device 14, and down hole water levels, are configured as operating ranges or "base" parameters. Once defined, the gas wellhead extraction device control system automatically adjusts the inputs, including the frequency of the variable frequency drive (VFD) connected to the gas wellhead extraction device 14, based, in part, on the measured values of all of the selected plurality of operating parameters in accordance with a software, code and proprietary controls programmed in the gas wellhead extraction device control system to avoid exceeding any selected operating limits, whether high or low, of any of the plurality of operating. Fully automated controls, including wireless remote monitoring, becomes absolutely crucial to ensure optimal operation by allowing the plurality of parameters to be monitored, recorded, adjusted, controlled, and relayed 24 hours a day.

In another embodiment, the gas wellhead extraction assembly 10 is provided with additional telemetry and/or High Speed Internet or web-accessible real-time control features that provide streaming real time data. The additional real time control features available in additional embodiments of gas wellhead extraction assembly 10 allows for satellite and/or wireless communications system via an encrypted data and voice stream that enable real-time remote monitoring, adjusting of the control system operating parameters and instructions, and wireless software updates to be sent to the control system by qualified personnel without any additional hardware requirements outside the equipment integrated into the fully automated control panel, then back to a remote computer system, such as a server that hosts a secure primary web site. Additionally, such wireless technology, telemetry, satellite, low frequency RF or like service, would provide global access to monitor, measure, adjust, program, control, or configure the operation of the gas wellhead extraction assembly 10, which may be completed in real time.

Figure 5:
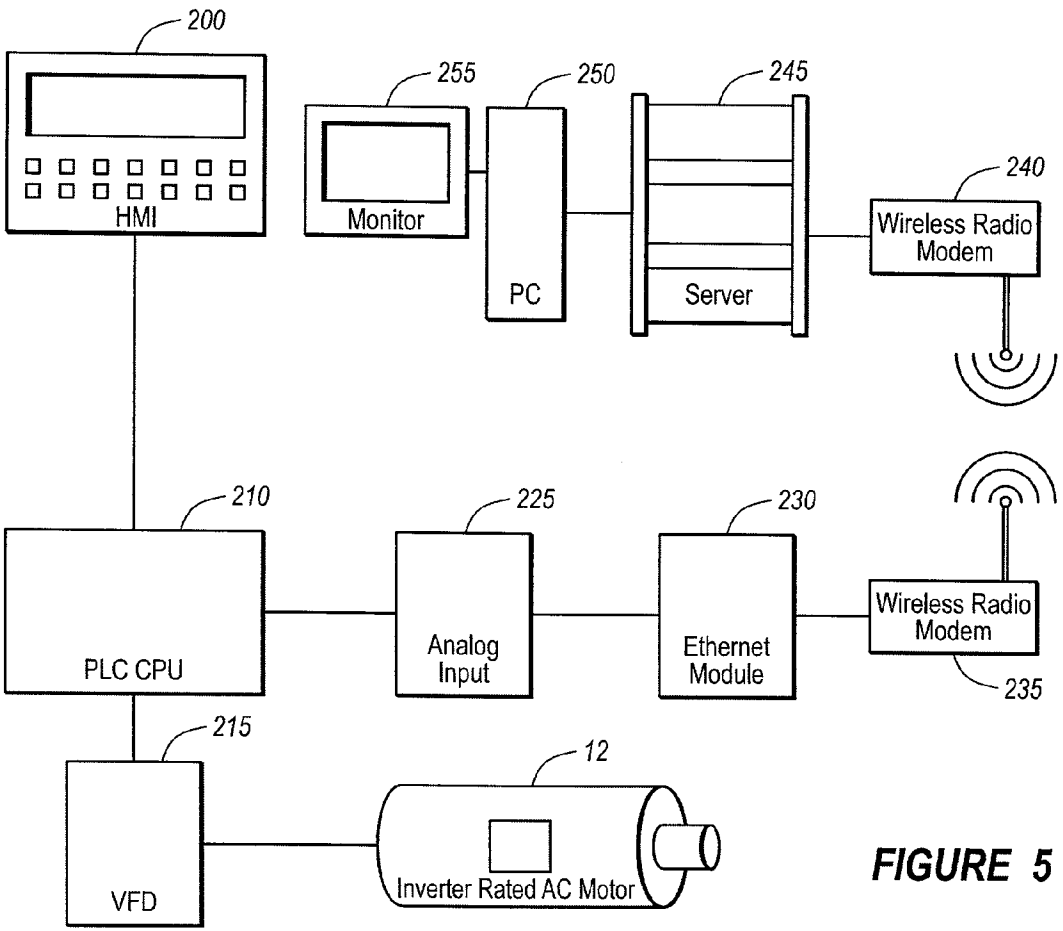
FIG. 5 illustrates one example of a block diagram of the controls for the gas wellhead extraction device assembly using an Ethernet connection.
Figure 6:
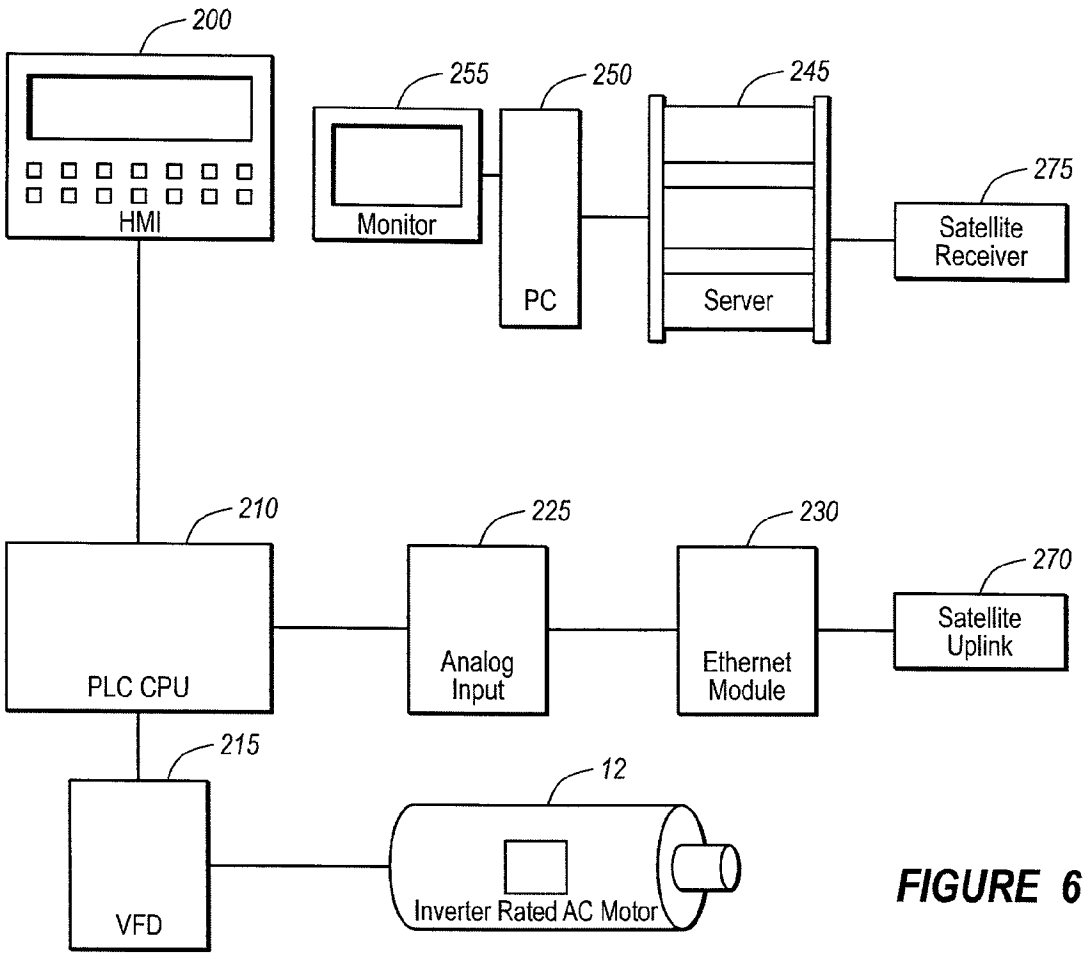
FIG. 6 illustrates one example of a block diagram of the controls for the gas wellhead extraction device assembly using a satellite uplink.

FIGS. 5 and 6 illustrate one example of a configuration through block diagrams of the communication system, including telemetry, low frequency RF, satellite or similar wireless control features, that comprise part of the automated control panel 100 (FIG. 4) of the gas wellhead extraction assembly 10 utilized to optimize performance and overall production capabilities via a wireless radio modem, standard or low frequency and satellite uplink combinations respectively. In FIG. 5, touch screen 200 provides the user with a means for communicating with and selecting or providing the processor 210, such as a PLC CPU, with operating parameters on-site at the physical location of gas wellhead extraction assembly 10. Touch screen 200 is on the exterior of a cabinet and is coupled to a processor 210, which is on the interior of the cabinet. Touch screen 200 typically requires multiple levels of password protection to prevent unauthorized access to varying levels of operation and overall control. Touch screen 200 also provides a manual start/stop for gas wellhead extraction assembly 10. Touch Screen 200 also displays fault conditions or codes and provides a user friendly means for determining the measured values of the plurality of operating parameters, the status of the plurality of the sensors, determining whether the selected operating limits of the operating parameters have been exceeded, and providing data to properly correct limitations to optimize gas flow in accordance with a software program, computer code, or other calculations.

The processor 210 is the "brains" of the control system. For example, the processor 210, such as a PLC CPU, may perform all primary calculations, houses the software code for performing calculations, monitors passwords, interacts with variable frequency drive (VFD) 215 to control the rate at which the gas wellhead extraction device 14 operates by adjusting the frequency of motor component 12 coupled to the gas wellhead extraction device 14. Additionally, the processor 210 may be coupled with a memory storage system, such as a hard drive, flash memory storage unit, externally erasable programmable Read Only Memory (EEPROM), removable memory card or stick, non-volatile random access memory, or similar device. The processor 210 would store the data measured by the plurality of sensors, the diurnal condition as measured by a photo-eye, the status of the motor component 12, the status of a downhole submersible pump and the water level measured therein, and the like. The data may be stored in a database with a corresponding time stamp, which may be a time entered and stored during the calibration of the unit, a local time, a standard global time (e.g., Greenwich Mean Time), or a time stamp/signal from the communication system (e.g., satellite or wireless time stamp.) By recording the data against time, the control panel and/or user may graph the data versus time, identify and analyze trends, or other troubleshooting steps. Further, if a network of gas wellhead extraction devices is employed in a particular oil or gas field, the data from each individual gas wellhead extraction assembly may be gathered at a remote computer system or server where a global analysis of the condition of the gas or oil field may be made.

In one embodiment, the CPU has 14 input points for the measured operating parameters of the plurality sensors, transducers, or like devices and 10 output points. In one embodiment a secondary set of "night time" operating parameters and control set points are activated by a photo eye control, with software and integrated code modification incorporated into the fully automated control system 100.

The processor 210 is coupled to the variable frequency drive control (VFD) 215. VFD 215 adjusts the speed of gas wellhead extraction device 14 via the motor component 12. In one embodiment, the motor component 12 consists of an AC electric three phase, premium efficient, 20 to 1 turn-down variable speed motor.

Information stored in processor 210 may be transmitted over an Ethernet module 230 to a wireless radio modem 235. The wireless radio modem 235 at or near the cabinet transmits data to another wireless radio modem 240 coupled to a secure server 245. (Note, the server may be secure physically, such as in controlled access computer room, as well as figuratively, through passwords, biometric controls, software locks, encryption, and the like.) Data may then be made available to an Internet website or IP address having a secure or encrypted access. A PC 250 having a monitor 255 may then access the secure site with proper passwords containing various levels of security limiting operational access, and therefore the data, from the IP address associated with secure server 245. Optionally, instead of a PC 250, the secure website may be accessed with a laptop, personal digital assistant, Internet or web-enabled cell-phone, or other like devices capable of securely accessing such data.

In FIG. 6, the operation may be essentially similar as the operation of FIG. 5, with the primary exception of the substitution of a two-way satellite uplink 270 or similar device for the wireless modem 235. Two-way satellite encryption and data transfer with high speed transmission and high speed data compression is a preferred method of uploading or downloading data from the processor 210, given that most remote areas are less likely to have wireless modem access. The satellite receiver 275 is configured to receive the potentially high speed compressed data and voice communications from the satellite uplink 270 and store the data in remote computer system, including a secure server 245 for viewing by means of PC 250, monitor 255, or other computer/web-enabled device as described above. Device 270 may also be configured to broadcasting high speed wireless including WiFi broadcast network and VoIP communications from such device thereby allowing on-site operations to utilize the network to check additional equipment without having to physically drive to each location. Device 270 may also be configured of offering WiFi, VoIP and high speed internet broadcast to an unlimited customer base when voice or wireless communications would be of benefit due to lack of infrastructure or reliability.

Remote or wireless programming including data uploads, downloads, and updates to software code and functionality is embodied within both systems illustrated in FIGS. 5 and 6. The user would issue commands from his/her PC 250 and monitor 255 or other computer/web-enabled device, which would follow the reverse path to the processor, or CPU, 210.

Figure 7:
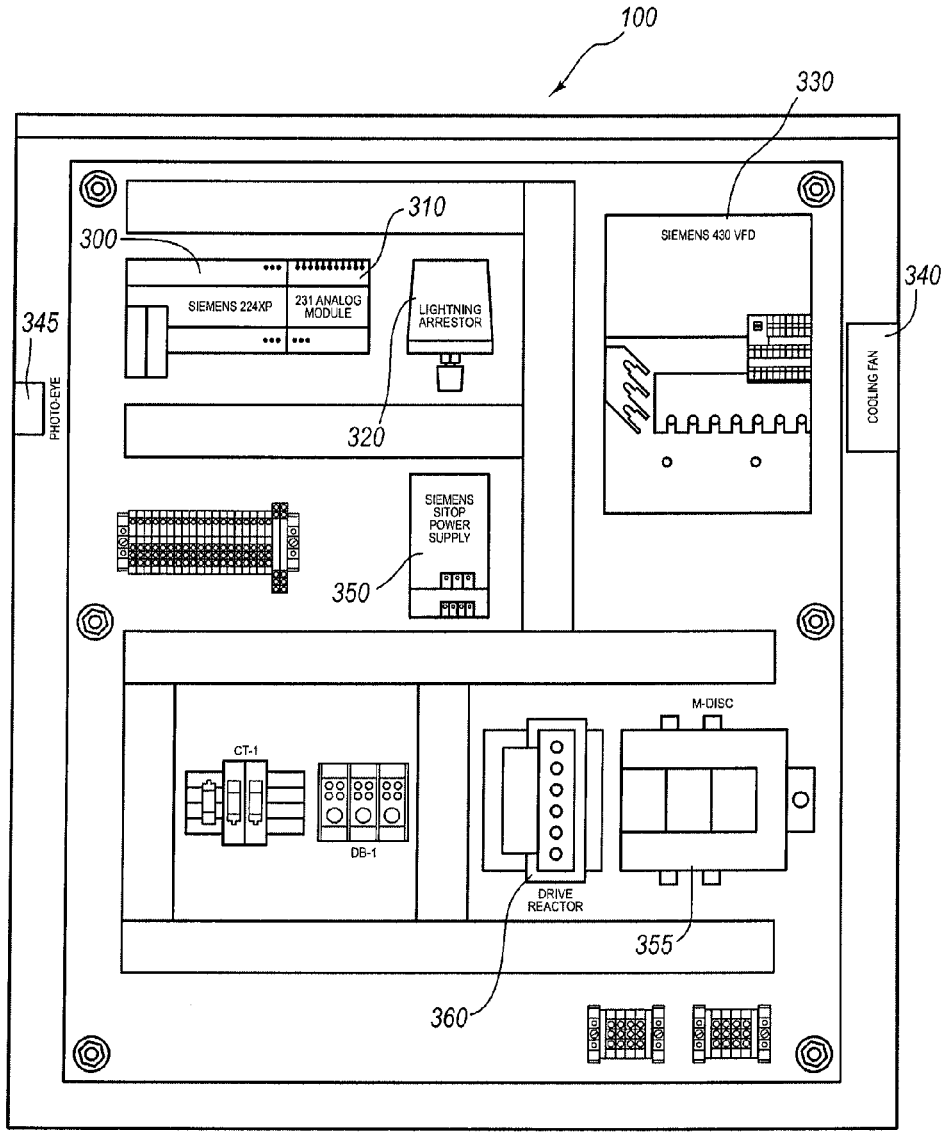
FIG. 7 illustrates one example of a front view of the interior of the fully automated control panel, illustrating the potential location of the various elements.

FIG. 7 illustrates one example (front view) of the internal configuration of fully automated and integrated control panel 100. In the illustrated embodiment, the processor, or CPU 300, and analog module 310 are located in the upper left portion of the fully automated and integrated control panel 100. A lightning arrestor 320 is included to protect the gas wellhead extraction assembly 10 from being struck by lightning. A photo-eye 345 is incorporated on the left side of control panel 100. The photo-eye 345 senses the onset of darkness, enacting a one hour time delay to a secondary set of night time operating parameters or "ramp-up." The VFD 330 is located on the right side of the fully automated and integrated automated control panel 100. Of course, other configurations of the component are contemplated and within the scope of the invention.

The secondary set of night time operating parameters is a more aggressive setting of the eight operating parameters, in which external ambient air temperature during the day becomes a limiting factor due to heat, and conversely the opposite at night. Photo-eye 345 regulates both day and night time operational settings of control panel 100 by sensing the onset of darkness and light. Accordingly, the processor, or CPU, 300 instructs the variable frequency drive (VFD) 330 to operate motor component 12 couple to the gas wellhead extraction assembly 10 more aggressively during nighttime hours, and less aggressively during daytime hours, due to the fact that night-time air naturally cools the gas wellhead extraction device 14 and the motor component 12 more effectively, allowing for higher speeds and overall operating settings. Thus, it may be possible to further enhance or optimize the performance of the gas wellhead extraction assembly 10 while remaining within the selected operating limits of the plurality of operating parameters.

Figure 8:
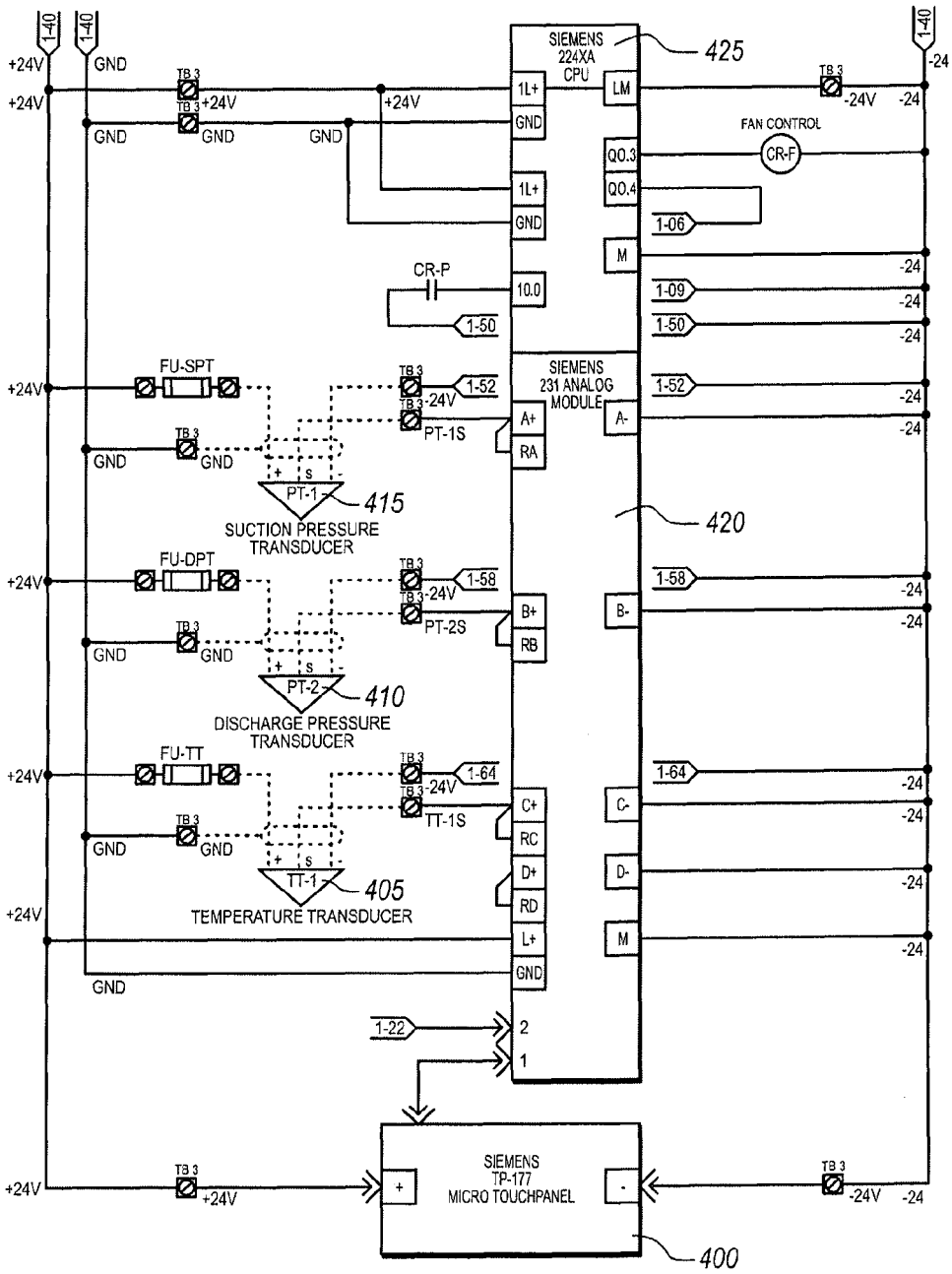
FIG. 8 illustrates one example of a first circuit diagram, illustrating the first portion of the control elements.
Figure 9:
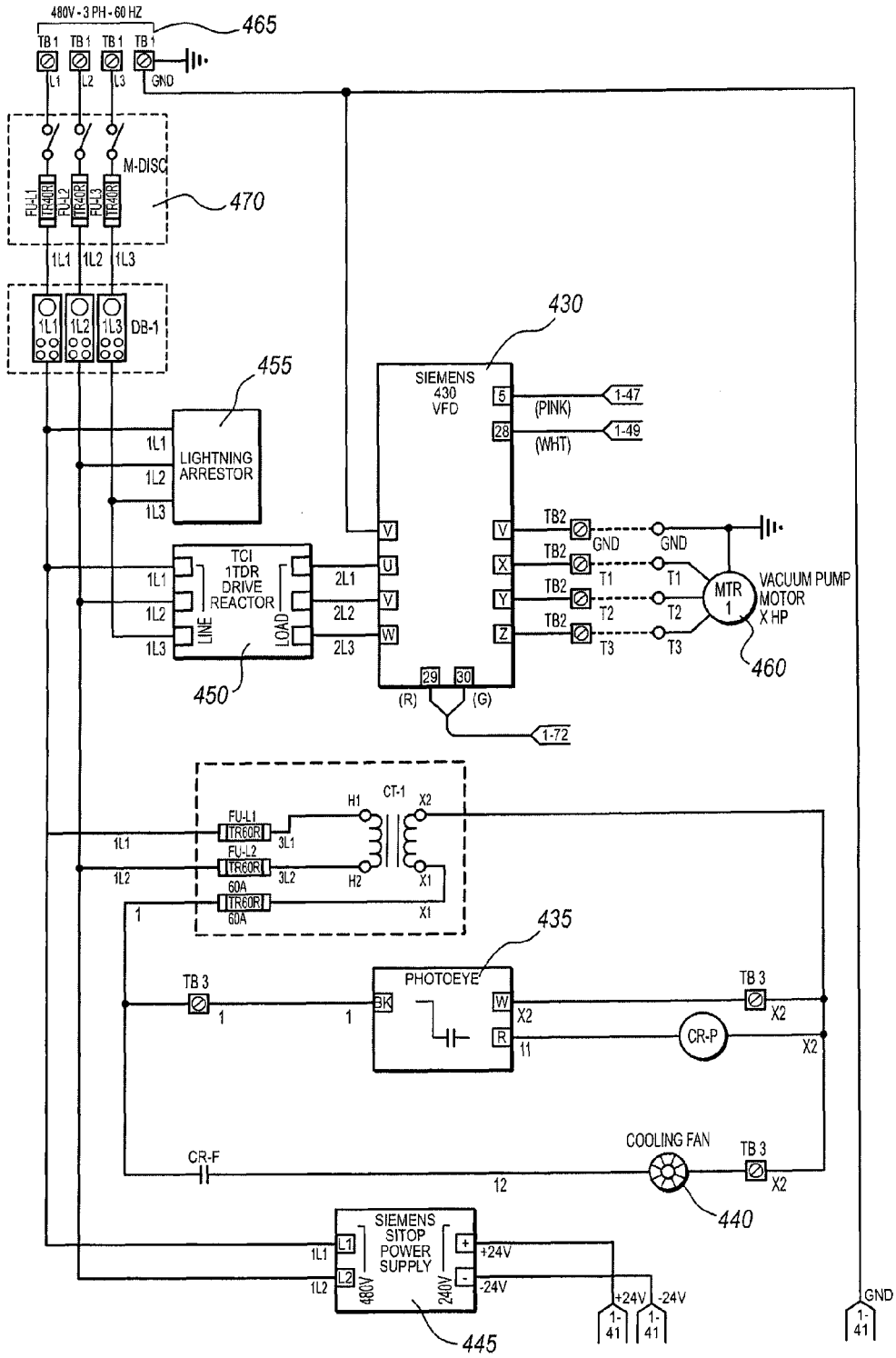
FIG. 9 illustrates one example of a second circuit diagram, illustrating a second portion of the control elements.

FIGS. 8 and 9 illustrate one wiring diagram embodiment for connecting the various elements of the fully automated control panel 100.

The present invention may be embodied in many other specific forms without departing from its spirit, operational advantages, or essential characteristics. The described embodiments are to be considered in all respects as only illustrative, and in no way restrictive. The full scope of the invention is, therefore, indicated by both the appended claims and the foregoing descriptions. All changes which come within the meaning and range of equivalency of the claims are to be embraced within their scope.

What is claimed is:

1. A method of automating control, remotely monitoring, and controlling, a gas extraction assembly coupled to gas pipeline section, said method comprising the steps of:

coupling said gas extraction assembly to either a gas wellhead or a first pipeline section to receive gas from said gas wellhead or said first gas pipeline section;

coupling said gas extraction assembly to either the outlet of a gas wellhead or a second pipeline section and providing gas to either the said outlet of a gas wellhead or the said second gas pipeline section;

coupling a control panel to a variable frequency drive of said gas extraction assembly and to a plurality of sensors configured to measure a plurality of operating parameters and to a sensor configured to measure an output parameter of said variable frequency drive;

measuring an output parameter of said variable frequency drive and said plurality of operating parameters at selected intervals and supplying signals reflective thereof to said control panel;

determining the diurnal condition at the location of said gas extraction assembly;

adjusting said output parameter of said variable frequency drive in response to said determined diurnal condition and said measured plurality of operating parameters;

repeating adjusting and measuring to maintain said output parameter of said variable frequency drive and said plurality of operating parameters at optimum values.

2. The method of claim 1, further comprising:

recording said output parameter of said variable frequency drive said plurality of operating parameters and said diurnal condition in memory storage system coupled to said control panel; and transmitting said output parameter of said variable frequency drive said diurnal condition and said plurality of operating parameters over secure communication system coupled to said control panel to a remote computer system.

3. The method of claim 2, wherein transmitting said output parameter of said variable frequency drive, said diurnal condition, and said plurality of operating parameters over a secure communication system further comprises:

encrypting said output parameter of said variable frequency drive, said diurnal condition, and said plurality of operating parameters; and transmitting said encrypted output parameter of said variable frequency drive, said diurnal condition, and said plurality of operating parameters over wireless communication system.

4. The method of claim 2, further comprising:

transmitting at least one of commands and software upgrades to said control panel from said remote computer system; and receiving confirmation at said remote computer system from said control panel acknowledging receipt of said commands and said software upgrades at said control panel.

5. The method of claim 1, wherein said output parameter of said variable frequency drive, said diurnal condition, and said plurality of parameters are measured at selected intervals.

6. The method of claim 5, wherein the repeating adjusting and measuring to maintain said plurality of parameters at optimum values further comprises maintaining said plurality of parameters at values at which at least one of a maximum gas production rate, a maximum return on investment, a maximum productive life of well, a maximum mean time between failure of the gas extraction assembly, and producing minimum amount of water is achieved.

7. The method of claim 1, wherein measuring said plurality of parameters comprises measuring suction pressure, discharge pressure, and further comprises measuring at least one of a discharge gas temperature, gas extraction device case temperature, gas flow rate, a gas composition, and a rotational velocity of gas extraction assembly.

8. The method of claim 7, further comprising determining differential pressure by calculating a difference between said measured suction pressure and said measured discharge pressure.

9. The method of claim 1, wherein said adjusting and measuring further comprises providing said gas extraction device with a bypass between an inlet to and an outlet from said gas extraction.

10. The method of claim 1, wherein said first pipeline section further includes an inlet flange.

11. The method of claim 1, wherein measuring an output parameter of said variable frequency drive and said plurality of operating parameters at selected intervals further comprises measuring, at a selected time interval, a selected clock time of a processor coupled to said control panel and total gas flow over selected time interval.

12. The method of claim 1, further comprising providing power to said gas extraction assembly.

13. The method of claim 12, wherein providing said power further comprises providing power from at least one of an electrical distribution system, a power system configured to convert portion of gas in said pipeline to electrical or hydraulic power, a solar power system and wind power system.

14. A gas extraction assembly, monitoring and control system comprising:

a gas extraction assembly having a gas extraction device, an inlet connection and an outlet connection configured to couple said gas extraction device in a gas pipeline, and a plurality of sensors configured to measure plurality of operating parameters, and a bypass valve assembly configured to allow gas contained within said pipeline to bypass said gas extraction device, said bypass valve assembly being coupled to said inlet connection and said outlet connection;

a control panel system operably coupled to said gas extraction assembly, said control panel system comprising:

a touch screen for manually or remotely programming said control panel system;

a variable frequency drive operably coupled to said gas extraction device, a processor operably coupled to said variable frequency drive, said bypass valve assembly, and said plurality of sensors;

a memory storage system operably coupled to said processor, to said plurality of sensors, to said variable frequency drive and to said bypass assembly and configured to store and retrieve data measured by said plurality of sensors, an operating condition of said variable frequency drive, and an operating condition of said bypass valve assembly; and a secure communication system operably coupled to said processor for communicating data to and from said control panel system from a remote location to monitor and control said gas extraction assembly.

15. The gas wellhead extraction assembly, monitoring and control system of claim 14, wherein said pipeline includes a first pipeline section connected to a wellhead.

16. The gas extraction assembly, monitoring and control system of claim 15, wherein the gas extraction device is a rotary blower.

17. The gas extraction assembly, monitoring and control system of claim 14, wherein the plurality of sensors comprise a transducer configured to measure suction pressure, a transducer configured to measure discharge pressure, and further comprising at least one of: a transducer configured to measure discharge gas temperature, a transducer configured to measure gas wellhead extraction device internal case temperature, a gas flow rate sensor, a gas composition sensor a sensor configured to measure the diurnal condition at the location of said gas extraction assembly, and a sensor to measure the frequency of said variable frequency device.

18. The gas extraction assembly, monitoring and control system of claim 17, further comprising a sensor configured to measure concentration of selected component of the gas passing through said gas extraction device.

19. The gas extraction assembly, monitoring and control system of claim 17 wherein said sensor configured to measure the diurnal condition of the location of said gas extraction assembly is a photo-eye.

20. The gas extraction assembly, monitoring and control system of claim 14, wherein said gas extraction assembly, monitoring and control system is configured to be at least one of explosion resistant, intrinsically safe, and pressurized.

21. The gas extraction assembly, monitoring and control system of claim 14, wherein the memory storage system further comprises one of a flash memory, an externally erasable programmable read only memory, non-volatile random access memory, and a removable memory card.

22. The gas extraction assembly, monitoring and control system of claim 14, wherein said secure communication system further comprises at least one of a satellite communication receiver/transmitter, an Ethernet connection, a wireless local area network and a wireless cellular network configured to transmit and to receive encrypted and non-encrypted data software updates, operating commands, and communications from said remote computer system.

23. The gas extraction assembly, monitoring and control system of claim 22, wherein said secure communication system is configured to transmit and receive software updates, operating commands, and communications from at least one of cellular phone, satellite phone, VoIP phone, computer enabled for wireless area network communication, and another gas extraction assembly, monitoring and control system proximate to said gas extraction assembly, monitoring and control system.

24. The gas extraction assembly, monitoring and control system of claim 14, wherein said remote computer system further comprises a remote computer server hosting at least one of a secure Internet-Protocol address and a secure web site, said secure Internet Protocol address and said secure web site being configured to securely communicate with at least one of a desktop computer, a laptop computer, a handheld personal digital assistant, and an internet enabled cellular phone.

25. The gas extraction assembly, monitoring and control system of claim 14, wherein the processor further comprises a computer and an operating software configured to control the operation of said gas extraction assembly, monitoring and control system.

26. The gas extraction assembly, monitoring and control system of claim 14, further comprising a power supply system configured to provide power to said gas extraction assembly, monitoring and control system.

27. The gas extraction assembly, monitoring and control system of claim 26, wherein said power supply system further comprises at least one of a connection to an electrical distribution system, a power system configured to convert portion of said gas in said pipeline to electrical or hydraulic power, a solar power system, and a wind power system.

28. The gas extraction assembly, monitoring and control system of claim 15, wherein said secure communication system broadcasts a WiFi signal utilized for at least one of general high speed internet access, VoIP or ISP in nontraditional manner.

* * * * *